US008651604B2

(12) United States Patent
Burton

(10) Patent No.: US 8,651,604 B2
(45) Date of Patent: Feb. 18, 2014

(54) PRINTHEADS

(75) Inventor: Gregory N. Burton, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 841 days.

(21) Appl. No.: 11/888,049

(22) Filed: Jul. 31, 2007

(65) Prior Publication Data

US 2009/0033695 A1 Feb. 5, 2009

(51) Int. Cl.
*B41J 29/38* (2006.01)

(52) U.S. Cl.
USPC ..... 347/9; 347/12; 347/50; 347/58; 347/59

(58) Field of Classification Search
None
See application file for complete search history.

(56) References Cited

U.S. PATENT DOCUMENTS

| | | | | |
|---|---|---|---|---|
| 5,122,812 | A | 6/1992 | Hess et al. | |
| 5,568,171 | A | 10/1996 | Keefe et al. | |
| 5,635,966 | A * | 6/1997 | Keefe et al. | 347/43 |
| 5,648,804 | A | 7/1997 | Keefe et al. | |
| 6,247,779 | B1 | 6/2001 | Nowell, Jr. et al. | |
| 6,260,952 | B1 | 7/2001 | Feinn et al. | |
| 6,267,468 | B1 | 7/2001 | Torgerson et al. | |
| 6,575,562 | B1 | 6/2003 | Anderson et al. | |
| 6,652,068 | B2 | 11/2003 | Hsu et al. | |
| 6,799,822 | B2 * | 10/2004 | Cleland et al. | 347/12 |
| 6,827,416 | B2 * | 12/2004 | Matsumoto et al. | 347/17 |
| 6,902,256 | B2 | 6/2005 | Anderson et al. | |
| 6,977,185 | B2 | 12/2005 | Bryant et al. | |
| 7,559,626 | B2 * | 7/2009 | Sakurai et al. | 347/50 |
| 2002/0130371 | A1 * | 9/2002 | Bryant et al. | 257/379 |
| 2005/0230493 | A1 | 10/2005 | Benjamin et al. | |
| 2006/0139410 | A1 | 6/2006 | Kawamura et al. | |
| 2007/0165071 | A1 | 7/2007 | Hirota | |

FOREIGN PATENT DOCUMENTS

| | | |
|---|---|---|
| CN | 1796125 | 7/2006 |
| EP | 0920999 | 6/1999 |
| JP | 62264961 | 11/1987 |
| WO | 2006062244 | 6/2006 |

OTHER PUBLICATIONS

International Search Report for Application No. PCT/US2008/071550. Report issued Dec. 4, 2008.

Supplementary European Search Report for EP 08 82 6873 dated Jul. 23, 2010 (3 pages).

* cited by examiner

*Primary Examiner* — Uyen Chau N Le
*Assistant Examiner* — Chad Smith

(57) ABSTRACT

Embodiments of a printhead are disclosed.

13 Claims, 10 Drawing Sheets

PRINTHEADS

Inkjet printing technology is used in many commercial products such as computer printers, graphics plotters, copiers, and facsimile machines. A frequent goal in inkjet printing is to provide reliable and good performing products at reasonable costs. The expense associated with the purchase of an inkjet pen can discourage purchase.

DETAILED DESCRIPTION

Figure 1:
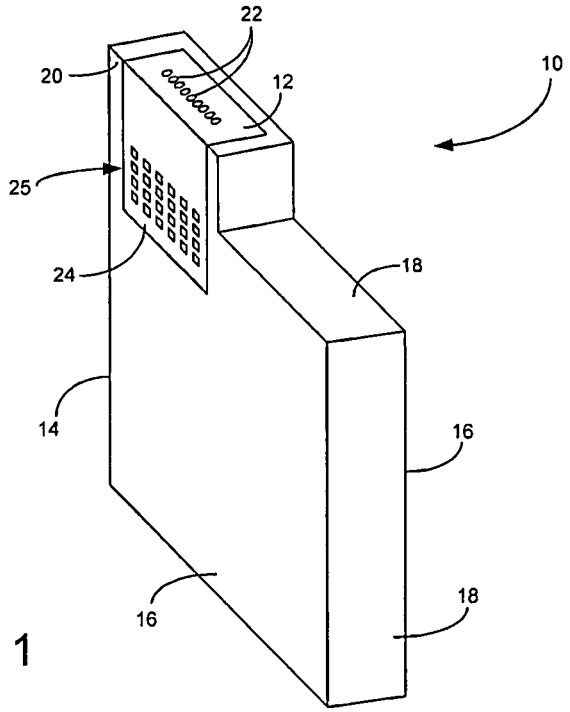
FIG. 1 is an isometric view of one embodiment of an inkjet pen.

Referring to the drawings wherein identical reference numerals denote the same elements throughout the various views, FIG. 1 shows an illustrative inkjet pen 10 having a printhead 12. The pen 10 includes a body 14 that generally contains a printing fluid supply. As used herein, the term "printing fluid" refers to any fluid used in a printing process, including but not limited to inks, preconditioners, fixers, etc. The printing fluid supply can comprise a fluid reservoir wholly contained within the pen body 14 or, alternatively, can comprise a fluid chamber inside the pen body 14 that is fluidly coupled to one or more off-axis fluid reservoirs (not shown).

The pen body 14, which typically, although possibly not, comprises a single-piece construction, includes two side panels 16 joined together by a narrow peripheral wall 18. Located in one corner of the pen body 14 is a snout or nosepiece structure 20 that protrudes outwardly. The pen 10 is shown in FIG. 1 in a nose-up orientation for clarity, although the pen 10 is normally operated in a nose-down orientation. The printhead 12 is mounted to the nosepiece structure 20 on the peripheral wall 18 and in fluid communication with the printing fluid supply. As will be described in more detail below, the printhead 12 generally comprises a die (i.e., a substrate having integrated circuitry formed thereon) and a nozzle member having a plurality of nozzles 22 through which drops of printing fluid are ejected. Although a relatively small number of nozzles 22 is shown in FIG. 1, the printhead 12 may have hundreds of such nozzles. A flex circuit 24 is provided for transmitting signals to and from the printhead 12. The flex circuit 24 is mounted to one side panel 16, adjacent to the nosepiece structure 20, with a portion thereof folded over the edge of the nosepiece structure 20 to engage the peripheral wall 18 and the printhead 12.

The printhead 12 can be mounted to the flex circuit 24 using Tape Automated Bonding (TAB). The combination of the printhead 12 and the flex circuit 24 is referred to as the TAB head assembly 25. In one embodiment, the printhead nozzle member is integral to the flex circuit 24, with the nozzles 22 being formed in the flex circuit 24 and the printhead die being attached to the flex circuit 24 in alignment with the nozzles 22. In another possible embodiment, the printhead nozzle member is a nozzle plate (typically metallic or polymeric) having the nozzles 22 formed therein and attached to the die. The flex circuit 24 has a cutout formed therein for receiving the nozzle plate.

Figure 2:
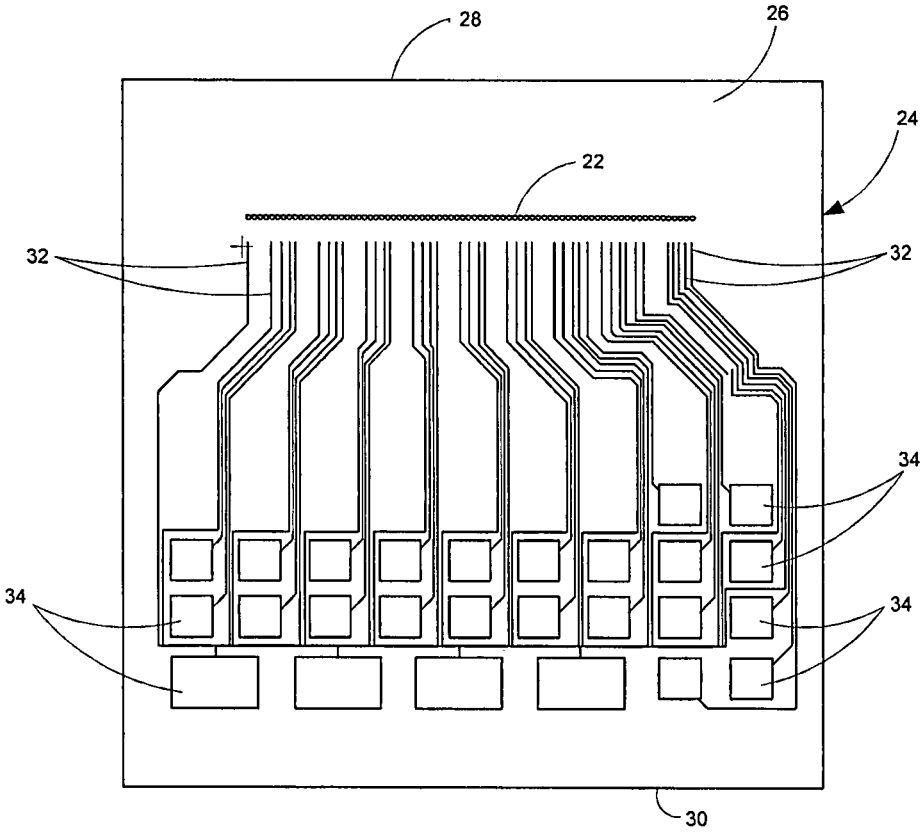
FIG. 2 is a plan view of an embodiment of a flex circuit.

One embodiment of the flex circuit 24 is shown in FIG. 2. The flex circuit 24 comprises a flexible tape 26 having a first end 28 and a second end 30 and made of polymer material, such as Kapton or Mylar. A single column of nozzles 22 is formed in the tape 26, the column generally extending across the tape 26 at a location near the first end 28. The nozzles 22 can be created by any suitable technique, such as laser ablation. A series of conductive traces 32 are formed on the back surface of the flexible tape 26 with, for example, a conventional photolithographic etching and/or plating process. (The flexible tape 26 is transparent in the illustrated embodiment so that the traces 32 are visible in FIG. 2 despite being formed on the back surface.) The conductive traces 32 generally extend lengthwise of the flexible tape 26 from a location near the column of nozzles 22 towards the second end 30. A number of conductive contact pads 34 are formed on the front surface of the flexible tape 26. The contact pads 34 are arranged in an array adjacent to the second end 30, and each contact pad 34 is in electrical contact with a corresponding one of the conductive traces 32. When the inkjet pen 10 is installed in a carriage, the contact pads 34 align with and electrically contact electrodes on the carriage. Typically, the carriage electrodes can be resiliently biased toward the pen to ensure reliable contact is made. The other end of each conductive trace 32 terminates near the column of nozzles 22.

Figure 3:
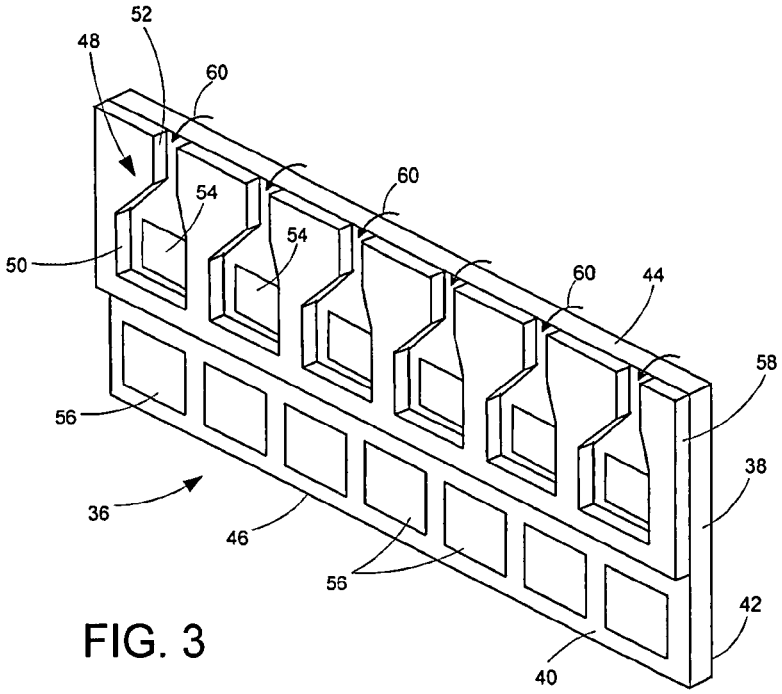
FIG. 3 is an isometric view of an embodiment of a printhead die.

FIG. 3 schematically shows one embodiment of a printhead die 36 that can be affixed to the back surface of the flexible tape 26 to form the TAB head assembly 25. The die 36 comprises a substrate 38, which is typically a rectangular piece of a suitable material, such as silicon, having a top surface 40 and an opposing bottom surface 42. The substrate 38 also has a first long edge 44 and an opposing second long edge 46. A plurality of drop generators 48 is formed on the top surface 40 along the first edge 44. While six drop generators are shown in FIG. 3, a die will typically have a large number of such drop generators. Each drop generator 48 includes a firing chamber 50, a feed channel 52 establishing fluid communication between the firing chamber 50 and the first edge 44, and a fluid ejector 54 disposed in the firing chamber 50. When the die 36 is attached to the flexible tape 26 to form the TAB head assembly 25, each firing chamber 50 is aligned with a corresponding one of the nozzles 22. The fluid ejectors 54 can be any device, such as a resistor or piezoelectric actuator, capable of being operated to cause drops of fluid to be ejected through the corresponding nozzle 22.

The die 36 includes integrated circuitry formed on the top surface 40 of the substrate 38, and the fluid ejectors 54 are part of the integrated circuitry. The integrated circuitry also defines a series of conductive bond pads 56 (seven shown in FIG. 3 for sake of example) that are formed on the top surface 40 along the second edge 46. The bond pads 56 make electrical contact with the conductive traces 32 when the die 36 is mounted on the flex circuit 24. As will be described in more detail below, the pads 56 include primitive select pads, address select pads and ground pads.

The firing chambers 50 and feed channels 52 are formed in a barrier layer 58 disposed over the integrated circuitry on the top surface 40. The barrier layer 58, which may comprise a layer of a photoresist or other polymer or epoxy material, is formed on the top surface 40 of the substrate 38 so as to cover most of the integrated circuitry except for the bond pads 56. The firing chambers 50 and feed channels 52 are formed in the barrier layer 58 using any suitable technique, such as conventional photolithographic techniques. In this embodiment, the drop generators 48 are formed along the first edge 44 and not the second edge 46, and the bond pads 56 are formed along the second edge 46 and not the first edge 44.

Figure 4:
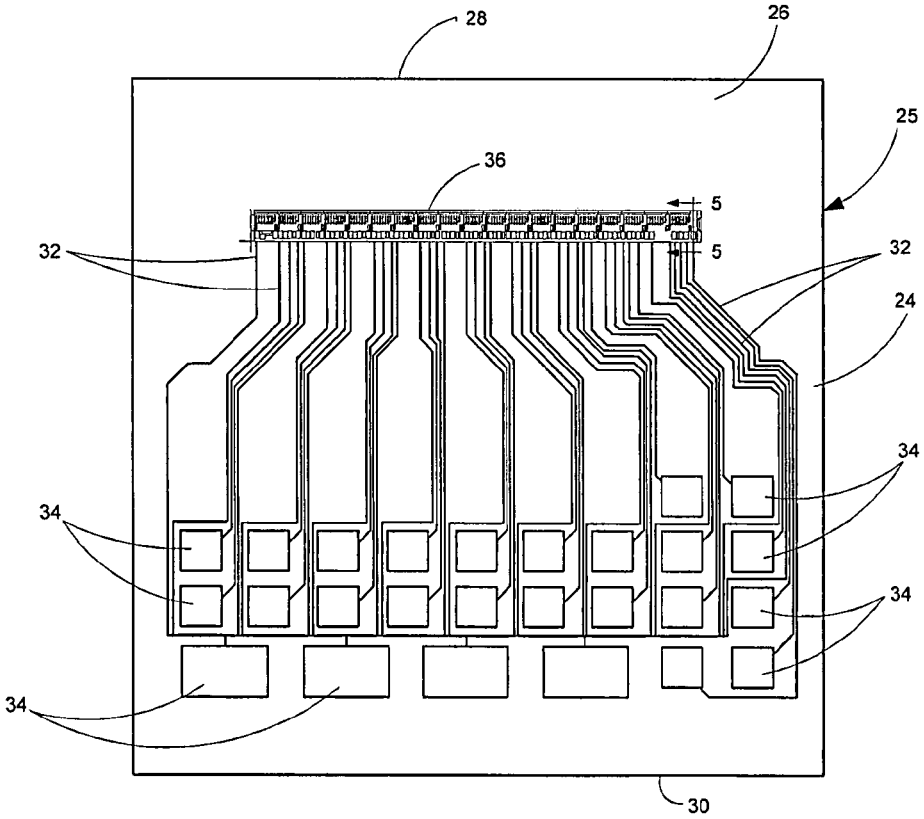
FIG. 4 is a plan view of an embodiment of a TAB head assembly.
Figure 5:
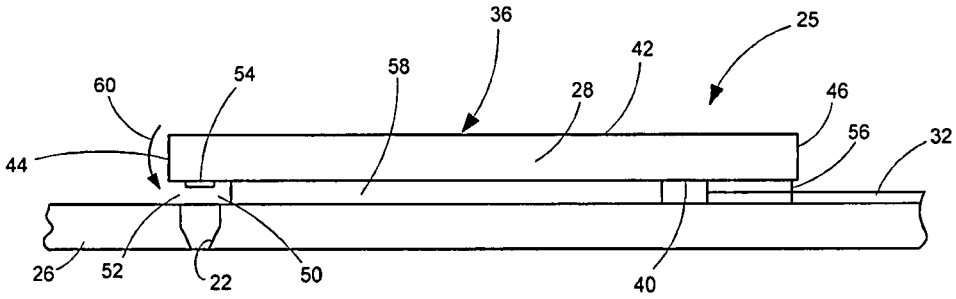
FIG. 5 is a cross-sectional view of the embodiment of the TAB head assembly taken along line 5-5 of FIG. 4.

Turning now to FIGS. 4 and 5, the TAB head assembly 25 with the die 36 mounted to the back surface of the flexible tape 26 is shown. (The die 36 is visible in FIG. 4 because the flexible tape 26 is transparent in the illustrated embodiment.) The die 36 is positioned with respect to the flex circuit 24 so as to precision-align the fluid ejectors 54 with the corresponding nozzle 22 formed in the flex circuit 24. (In this embodiment, the flex circuit 24 forms the printhead nozzle member.) The flex circuit 24 is subsequently staked to the barrier layer 58 in any suitable manner. For example, a thin adhesive layer (not shown) can be applied to the top surface of the barrier layer 58 to adhesively affix the die 36 to the back surface of the flex circuit 24. A separate adhesive layer may be omitted if the top of the barrier layer 58 can be otherwise made adhesive. The alignment step also inherently aligns the bond pads 56 with the ends of the conductive traces 32, and each trace 32 is bonded to the corresponding bond pad 56.

The TAB head assembly 25 is mounted to the pen body 14 so that a first portion of the flex circuit 24 is attached to one of the side panels 16, adjacent to the nosepiece structure 20, and a second portion of the flex circuit 24 is attached to the peripheral wall 18. The die 36 is received in a recess (not shown) formed in the outer surface of the nosepiece structure 20. When so positioned, the die 36 is in fluid communication with the printing fluid supply contained in the pen body 14. The side mounted flex circuit 24 allows the pen body 14 to be extremely narrow as compared to conventional pen bodies.

In operation, printing fluid flows from the printing fluid supply around the first edge 44 of the substrate 38 and into the firing chambers 50 via the feed channels 52, as shown by the arrows 60 in FIGS. 3 and 5. To eject a droplet from a given one of the nozzles 22, the associated fluid ejector 54 is activated. For example, in the case where the fluid ejectors are resistors, the selected resistor is energized with a pulse of electric current. The resulting heat from the resistor is sufficient to form a vapor bubble in the corresponding firing chamber 50, thereby forcing a droplet of printing fluid through the nozzle 22. The firing chamber 50 is refilled after each droplet ejection with printing fluid via the feed channel 52.

The die 36 is constructed such that printing fluid delivery occurs along a single edge (the first edge 44) and the bond pad connections are located along an opposing single edge (the second edge 46). The "edge-feed" fluid delivery has a number of advantages over previous center feed printhead designs which form an elongated central hole or slot running lengthwise in the substrate to allow printing fluid to flow into a central manifold and ultimately to the entrances of the feed channels. One advantage is that the substrate can be made narrower, due to the absence of the elongated central hole or slot in the substrate. In addition to the substrate being narrower, the length of an edge fed substrate can be shorter, for the same number of nozzles, than a center fed substrate due to the substrate structure now being less prone to cracking or breaking without the central feed slot. A smaller substrate lowers the material cost per die.

Using single edge bond pad connections allows the source of electric power to be kept relatively close to any given firing chamber. This reduces or eliminates the use of wide interconnect lines spanning long distances across the die, which are typical for standard "end-bonded" dies. Removing or reducing the use of substrate surface area devoted to wide interconnect lines and a central feed slot means that the die size can be reduced with respect to dies having wide interconnect lines and/or a central feed slot. Having the bond pads 56 spread along a single edge of the die 36 also provides for even distribution of electrical power and heat sinking, thereby keeping the operating temperature of the die 36 under good control during operation. Furthermore, the conductive traces 32 are not used to circumvent the printhead 12 and make bond pad connections on two opposite sides or ends of the die 36, the overall area of the TAB head assembly 25 is significantly reduced compared to conventional TAB head assemblies. This represents a significant cost reduction because less flex circuit material is used.

Figure 6:
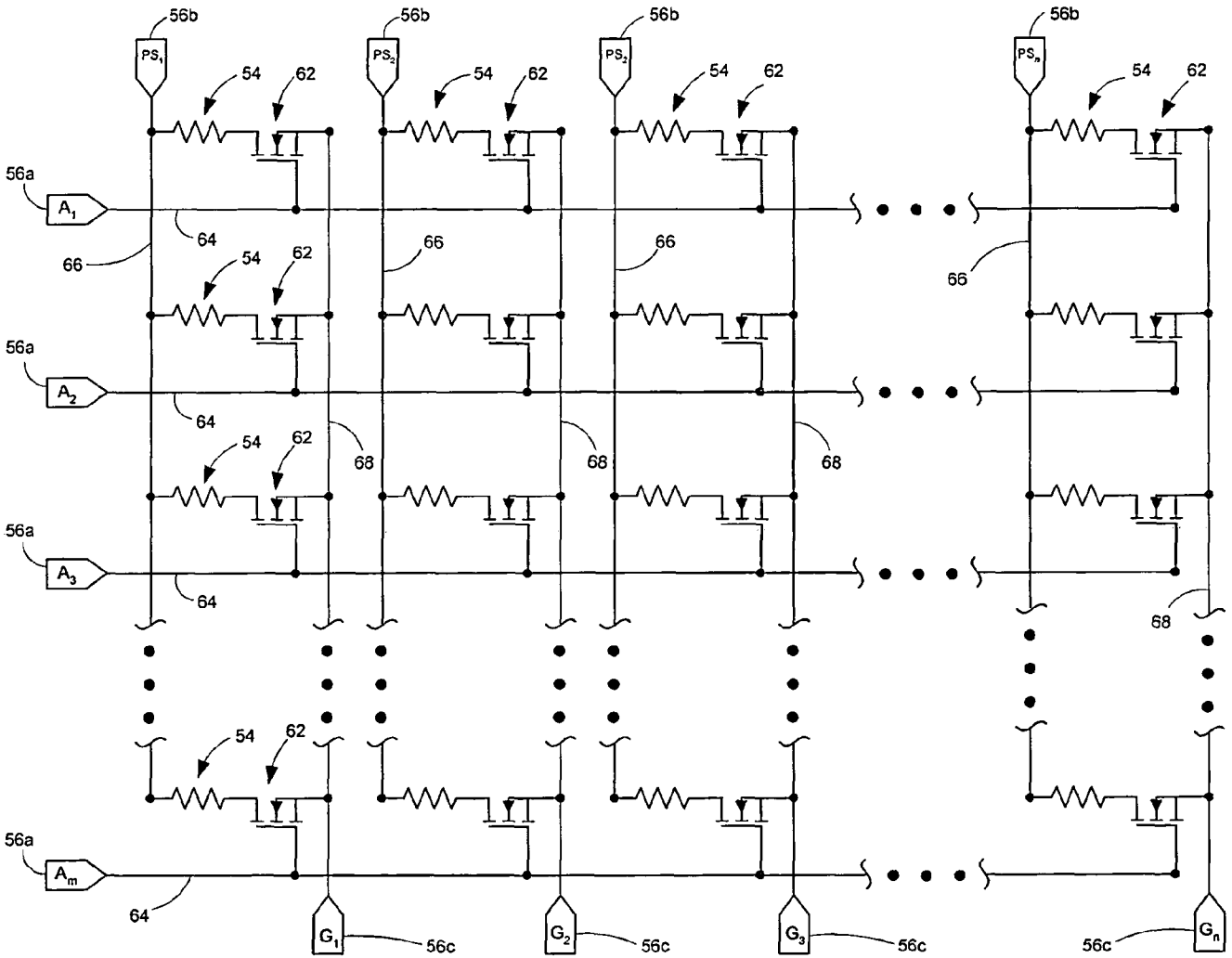
FIG. 6 is a schematic diagram of an embodiment of the integrated circuitry for an embodiment of a printhead die.

FIG. 6 is a schematic diagram depicting a representative portion of the integrated circuitry formed on the top surface 40 of the substrate 38. The circuitry includes the above-mentioned fluid ejectors 54, which by way of example are heating resistors in the illustrated embodiment, and additional circuitry for selectively actuating the fluid ejectors. The additional circuitry includes a drive transistor 62 associated with each heating resistor 54. The heating resistors 54 are organized into groups referred to as primitives, wherein each primitive comprises a group of adjacent heating resistors in which not more than one heating resistor is activated at a time. The interconnections for controlling the heating resistors 54 and drive transistors 62 include separate address select lines 64 connected to address bond pads 56*a*, primitive select lines 66 connected to primitive bond pads 56*b*, and common ground lines 68 connected to ground bond pads 56*c*. The driver circuitry of the illustrated embodiment comprises an array of N primitive select lines 66, N common ground lines 68, and M address select lines 64 to control M×N heating resistors 54. Each heating resistor 54 is controlled by its associated drive transistor 62, which shares an address select line 64 with one drive transistor 62 from each of the other primitives. Each heating resistor 54 in a primitive is connected to a common primitive select line 66 and a common ground line 68.

Figure 7:
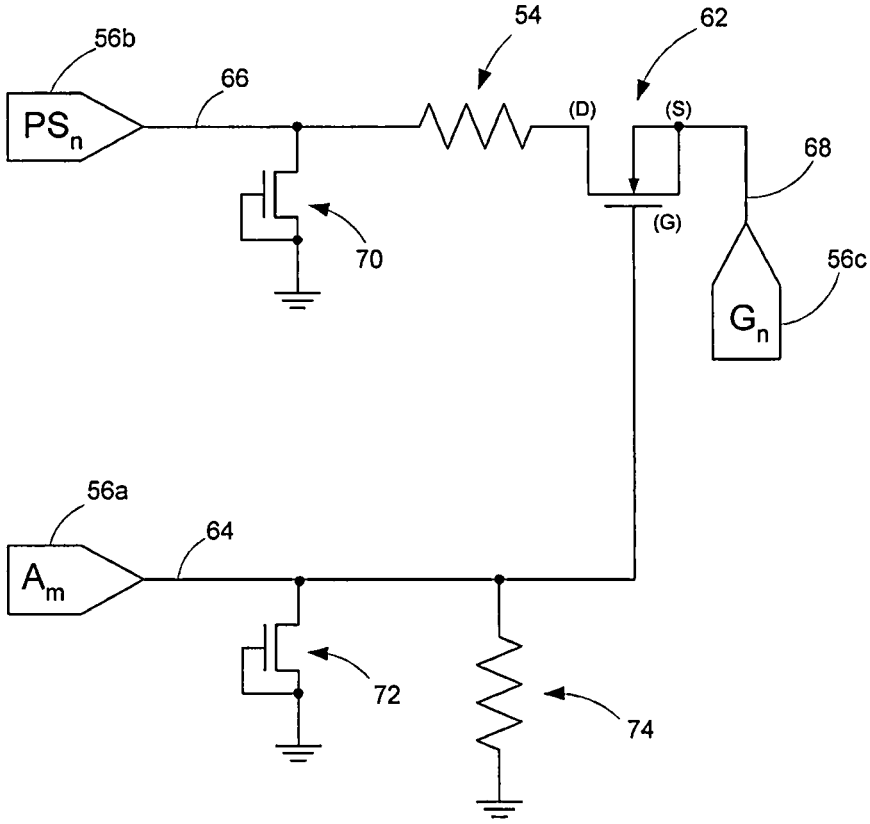
FIG. 7 is a schematic diagram of an embodiment of a fluid ejector and its associated drive transistor and interconnections.

Referring to FIG. 7, a schematic diagram of an individual heating resistor 54 and its drive transistor 62 is shown. In this embodiment, the drive transistor 62 is a field-effect transistor (FET) having a drain (D), a source (S) and a gate (G). The heating resistor 54 is connected to the primitive select line 66 and to the drain of the drive transistor 62. The source of the drive transistor 62 is connected to the common ground line 68, and the gate of the drive transistor 62 is connected to address select line 64. A first electrostatic discharge (ESD) transistor 70 is connected to the primitive select line 66, and a second ESD transistor 72 is connected to the address select line 64 for draining unwanted electrostatic charge. A pulldown resistor 74 is connected to the address select line 64 to place all unselected addresses in an off state.

Firing a heating resistor 54 involves applying a control voltage at its address bond pad 56*a* and an electrical power source at its primitive bond pad 56*b*. The address select lines 64 are sequentially turned on via appropriate interface circuitry. The address bond pads 56*a* are normally sequenced from $A_1$ to $A_m$ when printing from left to right and from $A_m$ to $A_1$ when printing from right to left. Where the primitive select line 66 and the address select line 64 for a given heating resistor 54 are both active simultaneously, that particular heater resistor 54 is energized.

One or more of the primitive select lines 66 is enabled in response to print commands from a print controller. Any number or combination of the primitive select lines 66 can be enabled concurrently, while not more than one address select line 64 is enabled at a time. This ensures that the primitive select line 66 and the common ground line 68 supply current to one heating resistor 54 at a time. Otherwise, the energy delivered to a heating resistor would be a function of the number of resistors being fired at the same time.

Figure 8:
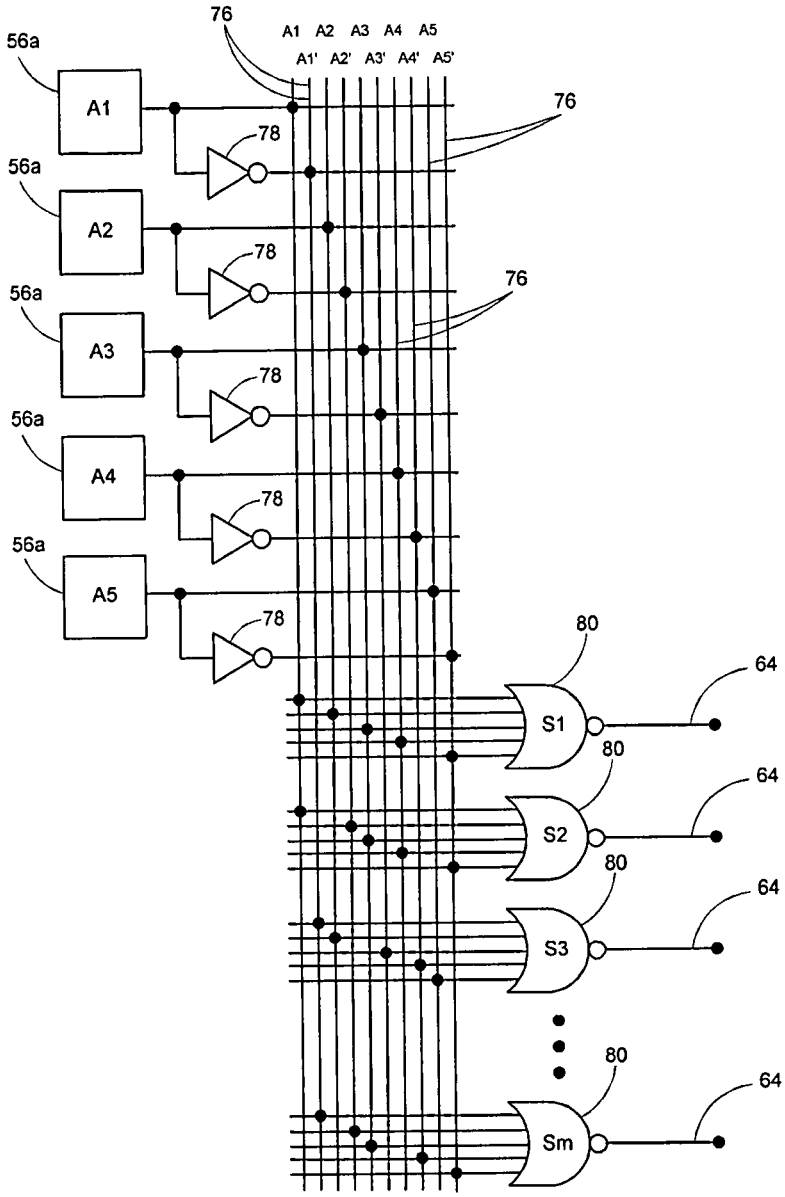
FIG. 8 is a schematic diagram of an embodiment of a binary decoder circuit.

The driver circuitry depicted in FIG. 6 includes one address bond pad 56*a* for each address select line 64. FIG. 8 shows a binary decoder circuit that can be used to reduce the number of address bond pads 56*a* formed on the die 36 for a given number of address select lines, thereby reducing the die size and the size of the flex circuit 24. The binary decoder circuit operates to selectively transmit signals from the address select bond pads 56*a* to the address select lines 64, where the number of address select bond pads 56*a* is less than the number of address select lines 64. By way of example, the binary decoder circuit is shown as having five address bond pads 56*a* (further identified as A1-A5) and ten conductive leads 76. Each address bond pad 56*a* is associated with a respective pair of the ten conductive leads 76, with each address bond pad 56*a* being directly connected to a first one of its leads 76 and being indirectly connected to a second one of its leads 76 via an inverter gate 78. The input of the inverter gate 78 is connected to the address bond pad 56*a* and the output of the inverter gate 78 is connected to the second lead 76. When a voltage is applied to an address bond pad 56*a*, there is a corresponding voltage on its first lead 76 but not its second lead 76, and when there is no voltage applied to an address bond pad 56*a*, there is a corresponding voltage on its second lead 76 but not its first lead 76.

The binary decoder circuit further comprises a number of NOR gates 80 (further identified as S1-Sm). The number of NOR gates 80 is equal to the number of address lines 64 used in the die 36, with the output of each NOR gate 80 being connected to a corresponding one of the address lines 64. In the illustrated embodiment, the NOR gates 80 are 5-input NOR gates with each input being connected to a different one of the ten conductive leads 76. The connections are made so that each NOR gate 80 is connected to a unique group of five leads 76. Thus, if the five address bond pads 56*a* are activated in such a manner that none of the five inputs of a given NOR gate 80 receives a signal, then that NOR gate 80 produces an output signal to its corresponding address line 64. If one or more of the inputs of a NOR gate 80 receives a signal, the NOR gate 80 does not produce an output. With this arrangement, a binary decoder circuit with five address bond pads 56*a* can accommodate 32 address select lines 64.

Figure 9:
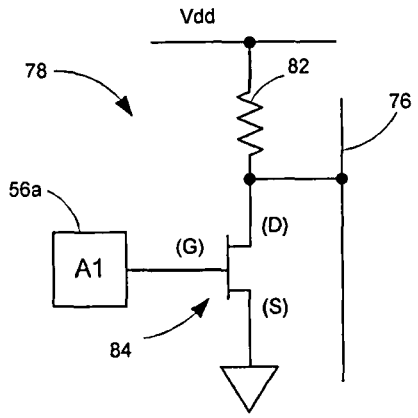
FIG. 9 is a schematic diagram of an embodiment of an inverter gate used in the binary decoder circuit.

Referring to FIG. 9, one possible embodiment of an inverter gate 78 is shown. In this case, the inverter gate 78 comprises a resistor 82 and a field-effect transistor 84 having a drain (D), a source (S) and a gate (G). The resistor 82 is connected to a supply voltage Vdd and to the drain of the transistor 84. The source of the transistor 84 is connected to ground, and the gate of the transistor 84 is connected to the corresponding address bond pad 56*a*, thereby functioning as the input of the inverter gate 78. The drain of the transistor 84 is also connected to the second conductive lead 76 associated with the corresponding address bond pad 56*a* to define the output of the inverter gate 84.

Figure 10:
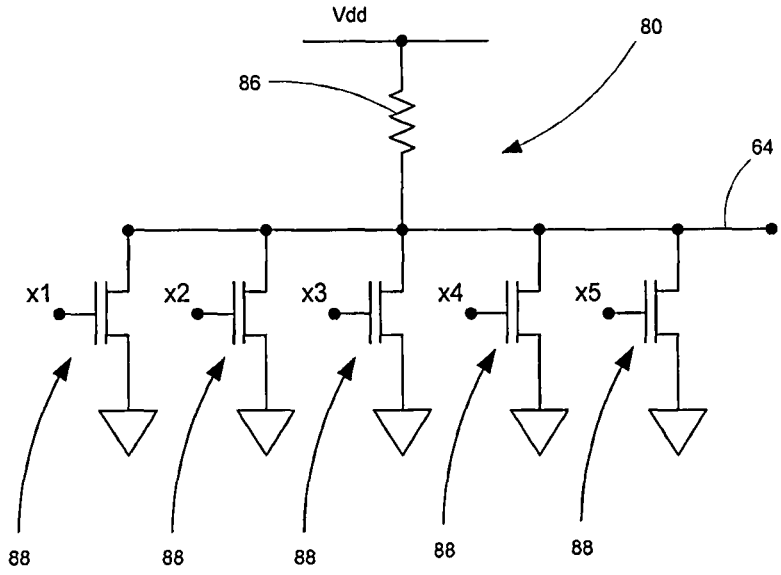
FIG. 10 is a schematic diagram of an embodiment of a NOR gate used in the binary decoder circuit.

Referring to FIG. 10, one possible embodiment of a NOR gate 80 is shown. In this case, the NOR gate 80 comprises a resistor 86 and five field-effect transistors 88. The resistor 86 is connected to the supply voltage Vdd and to each drain of the five transistors 88. The gates of the five transistors 88 function as the five inputs ($X_1$-$X_5$) to the NOR gate 80 and each gate is connected to a different one of the conductive leads 76. The source of each transistor 88 is connected to ground. Each of the drains is also connected to the address select line 64 corresponding to that NOR gate 80.

Figure 11:
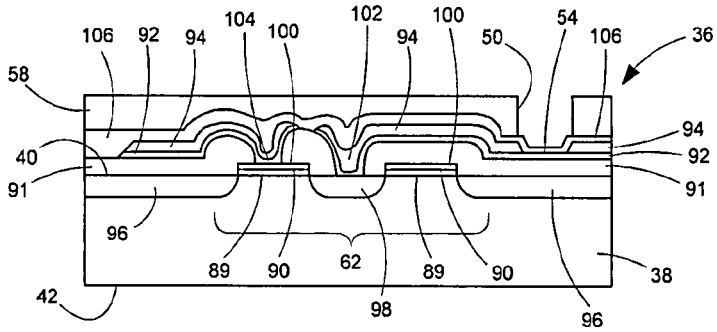
FIG. 11 is a cross-sectional view of an embodiment of a printhead die.

FIG. 11 shows one embodiment of a printhead die 36 comprising a substrate 38 and the integrated circuitry formed thereon. The substrate 38 is typically, although possibly not, comprised of silicon having a first planar surface 40 and a second planar surface 42, opposite the first surface. The die 36 has a layer of gate oxide 89 formed on the first surface 40 and a first conductive layer 90 formed on the gate oxide 89 for defining transistor gate regions. The die 36 further includes a plurality of fluid ejectors 54 (one is shown in FIG. 11 for clarity) disposed over the first surface 40 of the substrate 38 with an intervening dielectric layer 91 deposited on the first surface 40 for providing thermal isolation between the fluid ejectors 54 and the substrate 38. The dielectric layer 91 comprises any suitable material, such as phosphosilicate glass, and in one embodiment is deposited to a thickness in the range of about 5,000-20,000 Angstroms. The fluid ejectors 54 are made from a second conductive layer 92 that is deposited on the dielectric layer 91.

Each fluid ejector 54 is coupled to a drive transistor 62 (one is shown in FIG. 11 for clarity) formed in the substrate 38. This coupling is accomplished using a third conductive layer 94 deposited over the second conductive layer 92. An opening in the third conductive layer 94 defines each fluid ejector 54. Each transistor 62 includes a source active region 96, a drain active region 98 and a gate 100. In the illustrated embodiment, the transistors 62 are formed using a closed-loop gate structure to isolate the drain 98 within the inner portion of the closed-loop. The source 96 of the transistor 62 is located outside of the closed-loop gate. A first opening 102 is made in the dielectric layer 91 to allow the second conductive layer 92 to make contact with the drain 98 of the transistor 62; the third conductive layer 94 also contacts the fluid ejector 54 to couple the drain 98 and the fluid ejector 54. Also, a second opening 104 is made in the dielectric layer 91 to allow the second conductive layer 92 to make contact with the gate 100 of the transistor 62. A third opening (not shown in FIG. 11) is formed in the dielectric layer 91 to permit electrical contact with the source active region 96. To protect the fluid ejectors 54 from the reactive qualities of the printing fluid being ejected, a passivation layer 106 is disposed over the fluid ejectors 54 and the other thin-film layers deposited on the substrate 38. The barrier layer 58 defining the firing chambers 50 and feed channels 52 is directly on top of the passivation layer 106. No cavitation layer is disposed over the passivation layer 106 in this embodiment of the die 36.

Figure 12:
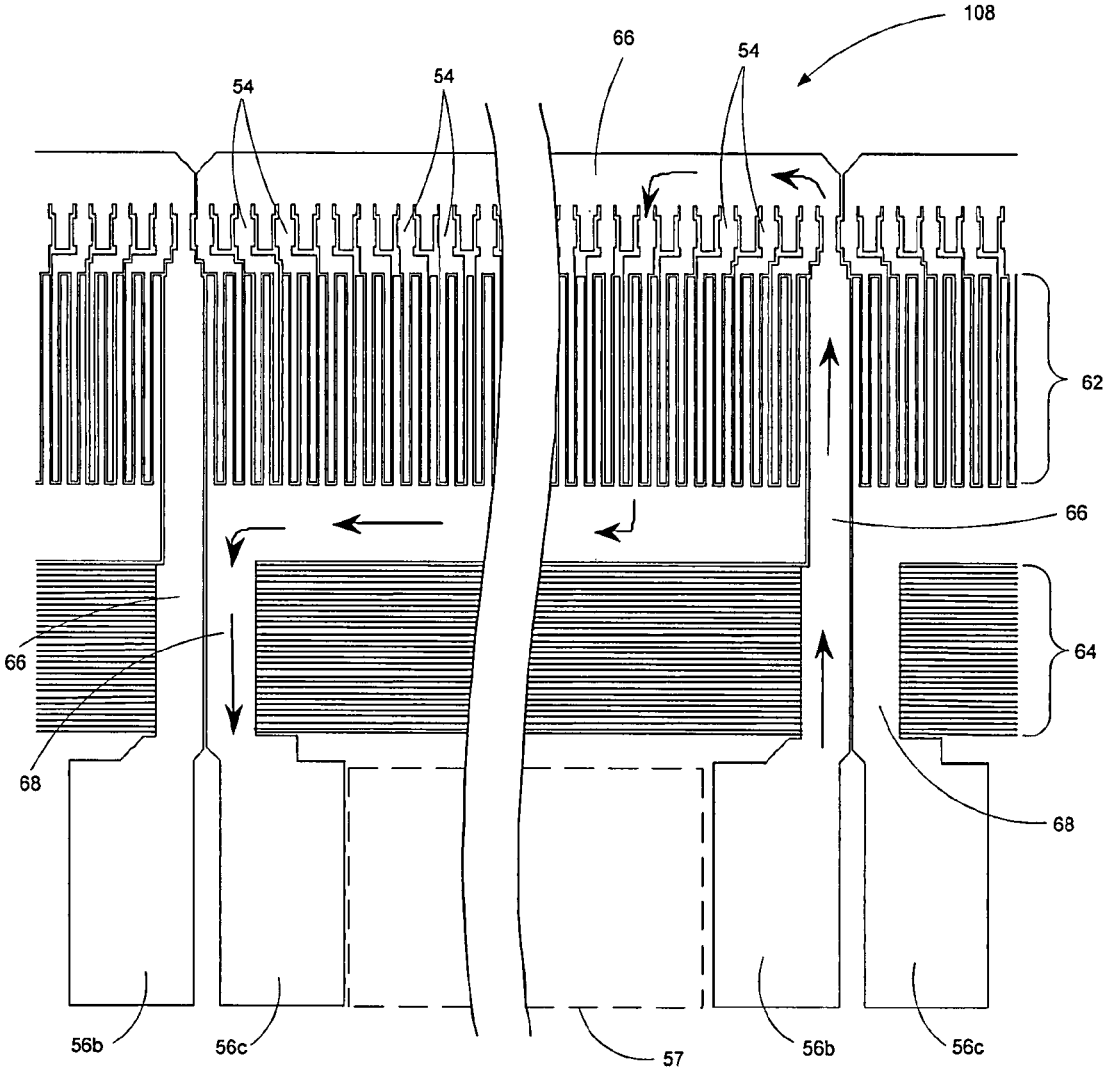
FIG. 12 is a top view of an embodiment of a printhead die.

FIG. 12 is a top view of the printhead die 36, with the barrier layer 58 removed for clarity, showing one embodiment of the layout for the integrated circuitry. The integrated circuitry includes a plurality of fluid ejectors 54, which are heating resistors in this embodiment. A nozzle (not shown in FIG. 12) is associated with each heating resistor 54. In this embodiment, the die 36 has 300 heating resistors 54 (each with a corresponding nozzle) arranged in a single column to cover a distance of one-half inch, which provides for a print resolution of 600 dots per inch (dpi). These heating resistors 54 are organized in ten primitive groups, each primitive group having thirty heating resistors 54. FIG. 12 shows one such primitive group 108 and a portion of each adjacent primitive group; the ten primitive groups are substantially similar. The thirty heating resistors 54 of the primitive group 108 share a common primitive bond pad 56*b* and a common primitive select line 66. The thirty heating resistors 54 of the primitive group 108 also share a common ground bond pad 56*c* and a common ground line 68. In this embodiment, the primitive group 108 also includes thirty drive transistors 62 that are connected to the heating resistors 54 and thirty address select lines 64.

While the heating resistors 54 (and the corresponding nozzles) are placed on 600 dpi centers along the length of the printhead die 36, the thirty drive transistors 62 within each primitive group are placed on a smaller pitch. This provides space at the end of the primitive group 108 for the metal trace defining the primitive select line 66 to be routed from the primitive bond pad 56*b* to the opposite side of the heating resistors 54. As depicted by the arrows in FIG. 12, current is routed along the primitive select line 66, through the selected heating resistor 54, through the associated drive transistor 62, and into the common ground line 68, which is connected to the source of each drive transistor 62 in the primitive group 108.

Figure 13:
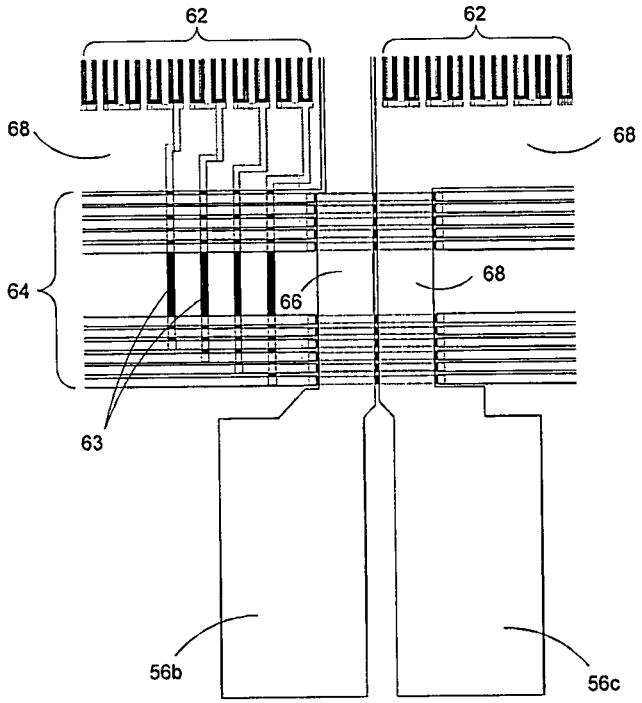
FIG. 13 is an enlarged view of a portion of the printhead die of FIG. 12.
Figure 14:
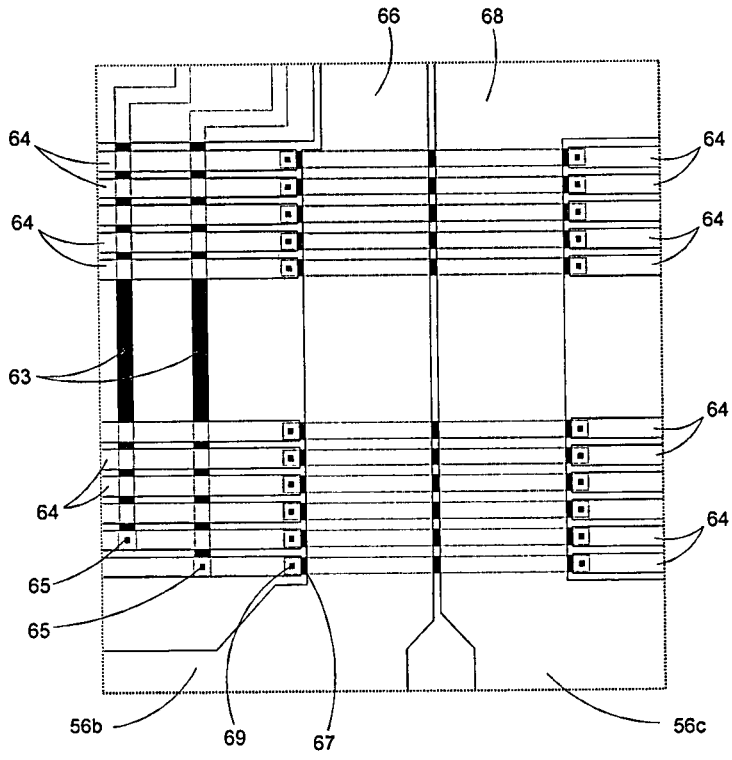
FIG. 14 is an enlarged view of a portion of the printhead die of FIG. 13.

The thirty address select lines 64 are physically located between the common ground lines 68 and the bond pads 56*b*, 56*c* and extend generally the entire length of the ten primitive groups. FIGS. 13 and 14 show the address select lines 64 and their connections in more detail. Specifically, each one of the thirty address select lines 64 is connected to the gate of a corresponding one of the thirty drive transistors 62 by a connector or "jumper" 63. In the illustrated embodiment, the jumpers 63 are formed in the first conductive layer 90, which can comprise polycrystalline silicon (polysilicon), and pass under the address select lines 64 and the ground line 68, which are formed in the third conductive layer 94. The jumpers 63 are electrically isolated from the address select lines 64 and the ground line 68 except for a contact 65 to the one address select line 64 the jumper 63 is connecting to a drive transistor 62. As best seen in FIG. 14, jumpers 67 and contacts 69 are used to route the address select lines 64 under the adjacent portions of the primitive select line 66 and the ground line 68.

Figure 15:
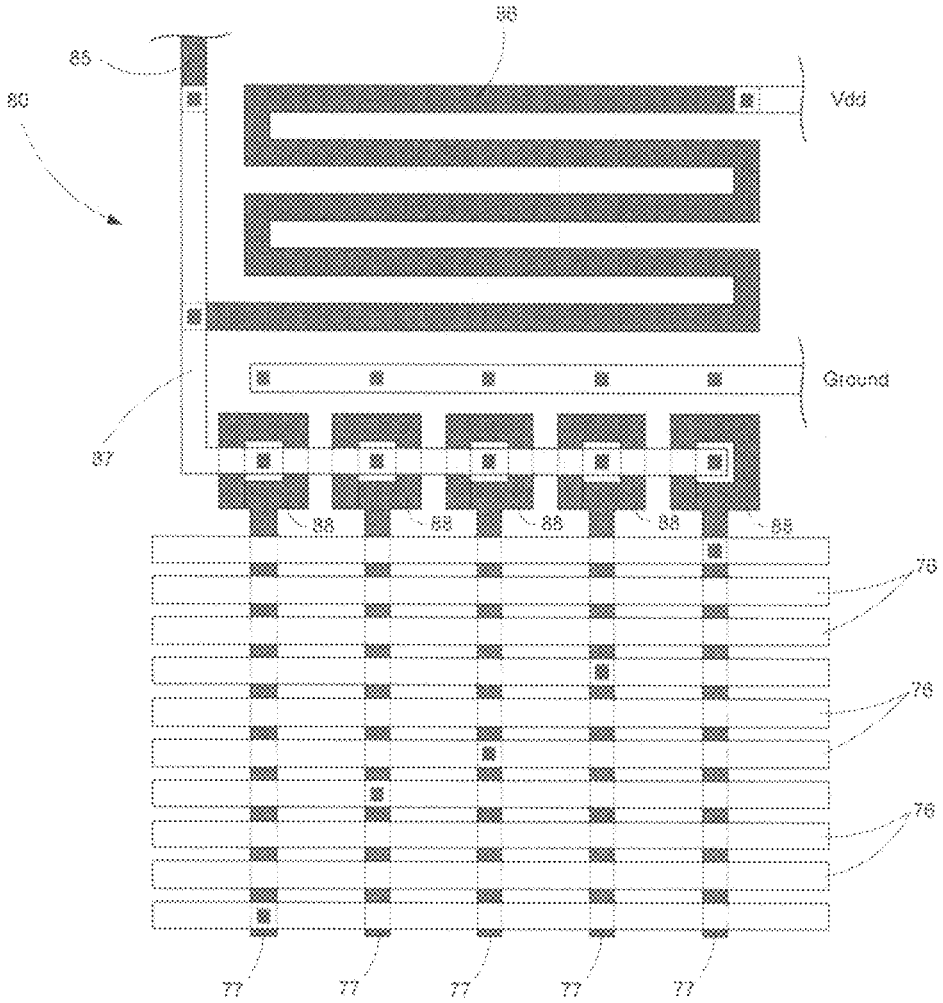
FIG. 15 is a top view of an embodiment of a NOR gate.

The space 57 between the primitive bond pad 56*b* and the ground bond pad 56*c* of the primitive group 108, depicted schematically in FIG. 12, can contain address bond pads, electrostatic discharge circuitry, and decoder circuitry. FIG. 15 shows one embodiment of the layout for a 5-input NOR gate 80 used in the binary decoder circuit described above. In this embodiment, the ten conductive leads 76 are traces formed in the third conductive layer 94. Five jumpers 77, formed in the first conductive layer 90, are routed below the conductive leads 76 to connect specific conductive leads 76 to the gates of the five adjacent transistors 88. These five jumper connections 77 constitute the five inputs to the NOR gate 80 that are schematically illustrated in FIG. 10 as inputs ($X_1$-$X_5$). The enclosed drains of the five transistors 88 are all connected to a line 87 formed in the third conductive layer 94. This line 87 represents the output of the NOR gate 80 and is connected to a corresponding one of the address select lines 64 via a jumper 85 formed in the first conductive layer 90. The load resistor 86 is formed in the first conductive layer 90 and is connected between the line 87 and the supply voltage Vdd. Thirty such NOR gates 80 are placed side-by-side in like fashion. The layout of each NOR gate 80 is identical except for the pattern of input connections to the ten conductive leads 76, which is unique to each of the NOR gates 80.

The printhead die 36 of FIGS. 12-15 uses a total of 26 bond pads to drive the 300 heating resistors 54. Specifically, there are ten primitive bond pads, ten ground bond pads, five address bond pads, and one supply voltage pad to supply Vdd potential that powers the binary decoder circuit.

Figure 16:
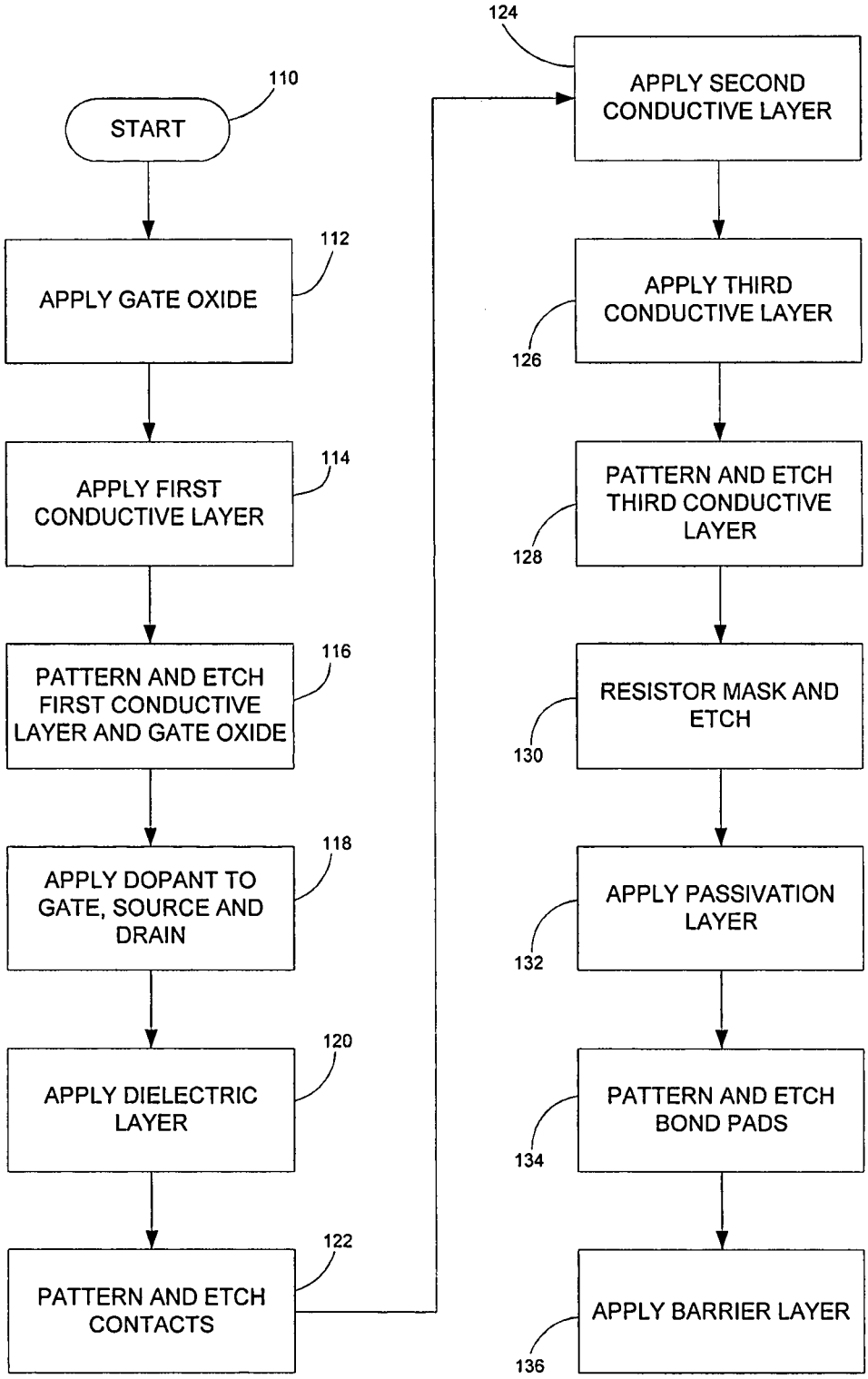
FIG. 16 is a flow chart depicting an embodiment of a process for fabricating an embodiment of a printhead die.

Referring to FIG. 16, one process for fabricating the die 36 is described. In block 110, the process starts with a doped substrate 38, which is in one embodiment a p-doped substrate for NMOS or an n-doped substrate for PMOS. In block 112, the layer of gate oxide 89 is applied on the first planar surface 40 of the substrate 38. In one embodiment, a layer of silicon dioxide is formed to create the gate oxide 89. Alternatively, the gate oxide 89 can be formed from several layers such as a layer of silicon nitride and a layer of silicon dioxide.

In block 114, the first conductive layer 90, such as a deposition of polycrystalline silicon (polysilicon), is applied on top of the gate oxide 89 and patterned with the gate mask and then wet or dry etched, as at block 116, into closed-loop structures to form the gate regions 100 from the remaining first conductive layer 90. In block 118, a dopant concentration is applied in the areas of the substrate 38 that are not obstructed by the first conductive layer 90 to create the active regions 96, 98 of the drive transistors 62. The drains 98 of the drive transistors 62 are formed in the substrate 38 within the closed-loop gate, and the sources 96 of the drive transistors 62 are formed in the substrate 38 in the area outside of the closed-loop structures.

In block 120, the dielectric layer 91, is applied over the first surface 40 to provide sufficient thermal isolation between the later-formed fluid ejectors 54 and the substrate 38. As mentioned above, the dielectric layer 91 is in one embodiment phosphosilicate glass (PSG) and is applied to a predetermined thickness (in one embodiment to a predetermined thickness in the range of about 5,000-20,000 Angstroms). The PSG is, in one embodiment, densified after being applied. Before applying the dielectric layer 91, a thin layer of thermal oxide can be applied over the source, drain and gate of the transistors 62. In block 122, a set of contact regions is patterned and etched in the dielectric layer 91 using the contact mask to form the openings 102, 104 as well as additional openings to the active regions of the drive transistors 62.

In block 124, the second conductive layer 92 is applied by deposition. The second conductive layer 92 can comprise any suitable electrically resistive material, such as tantalum aluminum. In block 126, the third conductive layer 94 is applied over the second conductive layer 92. The third conductive layer 94 can be made of any suitable material, such as aluminum, having less resistance than the second conductive layer 92 and is applied using any suitable technique such as sputtering. In block 128 the third conductive layer 94 is patterned with the metal1 mask and then etched to form the bond pads 56 and the various interconnections used to connect the bond pads 56, the active regions of the drive transistors 62, the gate regions of the drive transistors 62, and the fluid ejectors 54. In block 130, the third conductive layer 94 is patterned and etched to selectively remove portions of the third conductive layer 94 so as to expose portions of the second conductive layer 92 defining the fluid ejectors 54.

In block 132, a passivation layer 106 is applied over the previously applied layers on the substrate 38. In one embodiment, the protective passivation layer 106 is made up of a layer of silicon nitride and a layer of silicon carbide. In block 134, using a bond pad mask, the passivation layer 106 is patterned and etched to expose the portions of the third conductive layer 94 that will function as bond pads. In block 136, the barrier layer 58 is applied directly on top of the passivation layer 106, without any intervening cavitation layer or additional conductive layers. The barrier layer 58 can be applied as one or more layers of a photolithographic polymer or epoxy material that can be exposed and developed to form the firing chambers 50 and feed channels 52.

The use of additional conductive layers is reduced or eliminated by putting all electrical routing (i.e., all bond pads and interconnections) into the third conductive layer 94. The entire surface of the die 36, except for the bond pads 56, is encapsulated by the passivation layer 106. This protects the conductive layers from harmful moisture and/or ink vapors. This also represents a potential increase in the barrier layer adhesion. Furthermore, the use of non-corrosive materials (e.g., gold), which are typically employed for the topmost conductor in printhead manufacture, are reduced or eliminated. The use of a cavitation layer in the firing chambers 50 is reduced or eliminated by the fluidic architecture which has moved the bubble collapse away from the fluid ejectors 54. Elimination of these steps leads to a lower part cost, rapid fabrication turn-around time, and higher part yields.

The single edge fluid delivery reduces or eliminates the use of a trench etching and the associated oxygen ash; nor is there a use of drill slotting downstream (i.e., no sand-blasting or laser drill). In this case, the saw process that is typically used for the singulation of the die 36 also forms the feed edge.

While specific embodiments of the present disclosure have been described, it should be noted that various modifications thereto can be made without departing from the spirit and scope of the subject matter recited in the appended claims.

What is claimed is:

1. A printhead comprising:

a plurality of drop generators formed only along a first edge of a substrate, wherein the first edge is straight, wherein each drop generator includes a fluid ejector, the fluid ejectors are organized as primitives, and each primitive comprises a group of fluid ejectors in which not more than one fluid ejector is activated at one time;

N primitive select lines and M address select lines to control M×N fluid ejectors;

a plurality of bond pads formed only along a second edge of said substrate, wherein the second edge is straight and parallel to and opposing the first edge, wherein the plurality of bond pads includes address bond pads connected to the M address select lines and primitive bond pads connected to the N primitive select lines; and decoder circuitry for selectively transmitting signals from the address bond pads to the address select lines, wherein the number of address bond pads is less than the number of address select lines.

2. The printhead of claim 1 wherein said substrate is substantially rectangular and said first edge and said second edge are on opposing sides thereof.

3. The printhead of claim 1 wherein each drop generator includes a firing chamber, a feed channel establishing fluid communication between said firing chamber and said first edge, and the fluid ejector disposed in said firing chamber.

4. The printhead of claim 3 further comprising a drive transistor associated with each fluid ejector.

5. The printhead of claim 4, wherein each address select line is connected to one or more of said drive transistors.

6. The printhead of claim 1 wherein said decoder circuitry comprises:

a pair of conductive leads and an inverter gate associated with each address bond pad, each address bond pad being directly connected to a first one of its pair of conductive leads and being indirectly connected to a second one of its pair of conductive leads via its inverter gate; and a plurality of NOR gates, each NOR gate having an output connected to a corresponding one of said address select lines and a plurality of inputs connected to a corresponding group of said conductive leads.

7. The printhead of claim 3 further comprising a nozzle member defining a plurality of nozzles, each nozzle being associated with a corresponding one of said firing chambers.

8. A method of fabricating a printhead comprising:

applying a first conductive layer to a substrate to form transistor gate regions;

applying a dopant concentration to create transistor active regions;

applying a second conductive layer to create fluid ejectors organized as primitives, each primitive comprising a group of fluid ejectors in which not more than one fluid ejector is activated at one time;

applying a third conductive layer to create bond pads and all interconnections for connecting said bond pads, said transistor gate regions, said transistor active regions, and said fluid ejectors, wherein all of said bond pads are formed only along a first straight edge of said substrate and all of said fluid ejectors are formed only along a second straight edge of said substrate, wherein the second straight edge is parallel to and opposing the first straight edge, wherein the interconnections include N primitive select lines and M address select lines to control M×N fluid ejectors and the bond pads include address bond pads connected to the M address select lines and primitive bond pads connected to the N primitive select lines, wherein decoder circuitry selectively transmits signals from the address bond pads to the address select lines, wherein the number of address bond pads is less than the number of address select lines.

9. The method of claim 8 further comprising applying a passivation layer over said conductive layers.

10. The method of claim 9 further comprising applying a barrier layer directly on top of said passivation layer, said barrier layer defining firing chambers and feed channels.

11. The method of claim 8 further comprising applying a dielectric layer to provide thermal isolation between said fluid ejectors and said substrate.

12. The product of the method of claim 8.

13. A printhead made by a process comprising:

forming a plurality of drop generators only along a first straight edge of a substrate, wherein each drop generator includes a fluid ejector, the fluid ejectors are organized as primitives, and each primitive comprises a group of fluid ejectors in which not more than one fluid ejector is activated at one time;

forming N primitive select lines and M address select lines to control M×N fluid ejectors;

forming a plurality of bond pads only along a second straight edge of said substrate, wherein the second straight edge is parallel to and opposing the first straight edge, wherein the plurality of bond pads includes address bond pads connected to the M address select lines and primitive bond pads connected to the N primitive select lines; and forming decoder circuitry for selectively transmitting signals from the address bond pads to the address select lines, wherein the number of address bond pads is less than the number of address select lines.

* * * * *